US005622280A

United States Patent [19]

Mays et al.

[11] Patent Number: 5,622,280

[45] Date of Patent: Apr. 22, 1997

[54] METHOD AND APPARATUS FOR SEALING AN OPEN HEAD DRUM

[75] Inventors: Harry Mays; George Patton, both of Merced, Calif.

[73] Assignee: North American Packaging Company, Merced, Calif.

[21] Appl. No.: 518,891

[22] Filed: Jul. 6, 1995

[51] Int. Cl.[6] ..... B65D 53/00

[52] U.S. Cl. ..... 220/614; 220/378

[58] Field of Search ..... 220/614, 617, 220/619, 4.04, 320, 321, 378, 908

[56] References Cited

U.S. PATENT DOCUMENTS

| | | | |
|---|---|---|---|
| 3,103,293 | 9/1963 | Beutler | 220/321 |
| 3,243,075 | 3/1966 | Reinke | 20/614 X |
| 3,346,139 | 10/1967 | Armstrong, Jr. | 220/378 X |
| 3,790,020 | 2/1974 | Fine | 220/378 X |
| 4,381,844 | 5/1983 | Bondy | 220/378 |
| 4,821,911 | 4/1989 | Lefrant | 220/614 |

*Primary Examiner*—Steven M. Pollard

*Attorney, Agent, or Firm*—Townsend and Townsend and Crew LLP

[57] ABSTRACT

An open head drum (2) is provided with an improved seal for preventing the entrance of contaminating air during jarring transport of the drum. The conventional open head drum includes a hollow tubular drum body (4), an integrally attached circular end wall (12) closing one end of the hollow tubular drum body, and a lid seat (6) defined in the hollow tubular drum body adjacent the open end for receiving a removable drum lid (10). The removable drum lid is likewise conventional having an inner wall (16) for closing the open end of the hollow tubular drum body and an outer wall (18) for co-acting with the lid seat in sealed relationship for closing the hollow tubular drum body. The improved seal includes an endless sealing membrane (30) extending continuously around the lid seat and the removable drum lid. The endless sealing membrane has a first annular portion (38) attached to the lid seat, a second annular portion (40) attached to the removable drum lid, and a flexible annular portion (42) between the first and second annular portions. When separation of the removable lid from the seat occurs, the endless sealing membrane at the flexible annular portion prevent ingress of atmosphere interior of the drum. A process of installation of the seal is disclosed together with the seal as an article of manufacture.

13 Claims, 3 Drawing Sheets

METHOD AND APPARATUS FOR SEALING AN OPEN HEAD DRUM

FIELD OF THE INVENTION

This invention generally relates to the storage and transportation of food products in so-called 55 gallon drums. More specifically this disclosure relates to an apparatus and method for sealing an open head drum to prevent the entrance of contaminating air during jarring transport of the drum.

BACKGROUND OF THE INVENTION

Many perishable food products, such as diced tomatoes, are transported and stored within large cylindrical barrels or drums, e.g., 55 gallon drums. In the packaging industry, 55 gallon drums are generally classified as either tight head drums or open head drums.

Tight head drums include a hollow tubular body and circular end walls or lids. The lids are seam rolled to the top and bottom of the tubular body with a double seam rolled construction. Access to the contents of the open head drum can occur through an narrow entrance or bung which is typically in the center of one circular lid of the drum.

When an open drum is shipped to a destination, a narrow opening or bung is sometimes deemed insufficient to empty the drum of its contents. Frequently, drums must be opened to their full diameter to be emptied of their contents.

Full diameter opening of a tight head drum results in partial destruction of the drum. Typically, a cut is made through the drum cylindrical side immediately below the rolled seams which fasten the circular drum lid to the cylindrical body of the drum. Specialized cutting tools are manufactured for this purpose. With this cut made, the lid is thereafter forced off to expose the full diameter of the now open drum. Once the lid is removed, the tight head drum cannot be re-used without extensive remanufacturing.

It is known that opened tight head drums can be salvaged to form an open head drum of slightly reduced capacity. To accomplish this, a lid seat is cold rolled around the open end of the drum to form a drum seat from the cylindrical wall. The lid is thus modified so that it will engage a lid seat to close the open end of the drum. Naturally, the tight head drum is salvaged to a reduced capacity open head drum at increased cost.

So-called open head drums are known, opening to the full diameter of the transporting 55 gallon drum. Open head drums typically have a removable lid. This removable lid has a lid seat at the open end of the tubular drum body. When in place on a corresponding drum seat fashioned at the cylindrical top of the drum, and with a gasket between the drum seat and lid, the removable lid closes the drum. Unfortunately, and because of the nature of this seal, such drums are vulnerable during shipment. Specifically, where the drum is jostled during transport, both the lid and the cylindrical drum can deform. The result is that the lid momentarily separates from the drum seat. During such momentary separation, air enters the drum. This air can cause spoilage of the contents of drums carrying perishable food products such as diced tomatoes, tomato paste, fruit purees, etc.

For most commercial products shipped in open head drums, the lid is secured to the lid seat with an annular bolt ring. To open the drum and access the interior contents, the bolt ring is unlocked. Thereafter, the lid is pried off the lid seat. It is important to understand that even the protection of the annular bolt ring cannot provide sufficient protection for open head drums carrying perishable food products. A hermetic seal is required.

Open head drums have a major shortcoming. The seal between the lid and lid seat is not completely air tight, even with a bolt ring in place. When the drum is jostled during transport, flexure of both the lid and the cylindrical drum body occurs. With such dual flexure, the lid will momentarily separate from the lid seat, allowing air to enter the interior of the drum. The oxygen in the air contaminates the food products in the drum and eventually leads to product spoilage.

In regular packaging, secondary seals are used. Such secondary seals often include a membrane under a lid. This membrane acts as a seal when the lid is either removed or jostled during transport. For example, the cosmetics industry typically seals small containers, such as make-up jars, with a circular membrane that is attached to a lid seat of the jar underneath the lid. These types of secondary seals, however, would be costly to fabricate for the relatively large open head drums, and they are generally not designed to withstand the intense shaking, bouncing and jarring that open head drums are forced to undergo.

SUMMARY OF THE INVENTION

An open head drum is provided with an improved seal for preventing the entrance of contaminating air during jarring transport of the drum causing temporary separation of the drum seat and lid. The improved seal is installed to conventional open head drum and includes a hollow tubular drum body, an integrally attached circular end wall closing one end of the hollow tubular drum body, and a lid seat defined in the hollow tubular drum body adjacent the open end. The removable drum lid is likewise conventional having an inner wall for closing the open end of the hollow tubular drum body and an outer wall for co-acting with the lid seat. The improved seal includes an endless sealing membrane extending continuously around the lid seat and the removable drum lid. The endless sealing membrane has a first annular portion attached to the lid seat, a second annular portion attached to the removable drum lid, and a flexible annular portion between the first and second annular portions. When temporary separation of the removable lid from the seat occurs, the endless sealing membrane at the flexible annular portion prevents ingress of atmosphere interior of the drum. A process of installation of the seal is disclosed together with the seal as an article of manufacture.

The sealing membrane preferably comprises a plastic material that is substantially impermeable to oxygen to seal the interior of the drum. In the preferred embodiment, the plastic is extrusion formed into an elongate strip having a cross-sectional shape generally conforming to the lid seat at a first portion, conforming to the inner surface of the lid at a second portion and having the required flexible portion between the first and second portion. The plastic strip is then dispensed around the lid seat and cut to a length so that its ends overlap each other. The ends are fused together to form a continuous and endless sealing membrane.

Thereafter, the outer portion of the sealing membrane is bonded to the lid seat, preferably with a conventional bonding agent. The lid is then pressed down and sealed to the inner portion of the sealing membrane with the bonding agent to close off and seal the open end of the drum. The required bond is accomplished by exposing the assembled drum to an elevated temperature for a prescribed period of time. A flexible portion of the sealing membrane is left between the portion bonded to the drum and the portion bonded to the lid.

The apparatus and method of the present invention provide a number of advantages, particularly in respect to the transportation of perishable food products. The elastic annular portion of the sealing membrane will flex or give way when the lid separates from the lid seat so that the sealing membrane does not tear and the seal remains airtight. This allows perishable food products to be safely transported in open head drums, rather than tight head drums. In addition, the annular sealing membrane is relatively narrow since it is only required to extend between the lid seat and a portion of the removable lid interior of the drum body. Therefore, fabrication of the sealing membrane of the present invention is relatively inexpensive and uncomplicated.

Other advantages are that the open head drum thus constructed is easily opened by removing the bump ring by cutting the wire or plastic tie, cutting the sealing membrane and then removing the head. No special tools other than wire snips and a knife are required. A second advantage is that the emptied open head drum has more value in the aftermarket since it can be used as a full sized open head drum without any remanufacturing process.

Other features and advantages of the invention will appear from the following description in which the preferred embodiment has been set forth in detail in conjunction with the accompanying drawings.

DESCRIPTION OF THE PREFERRED EMBODIMENTS

Figure 1:
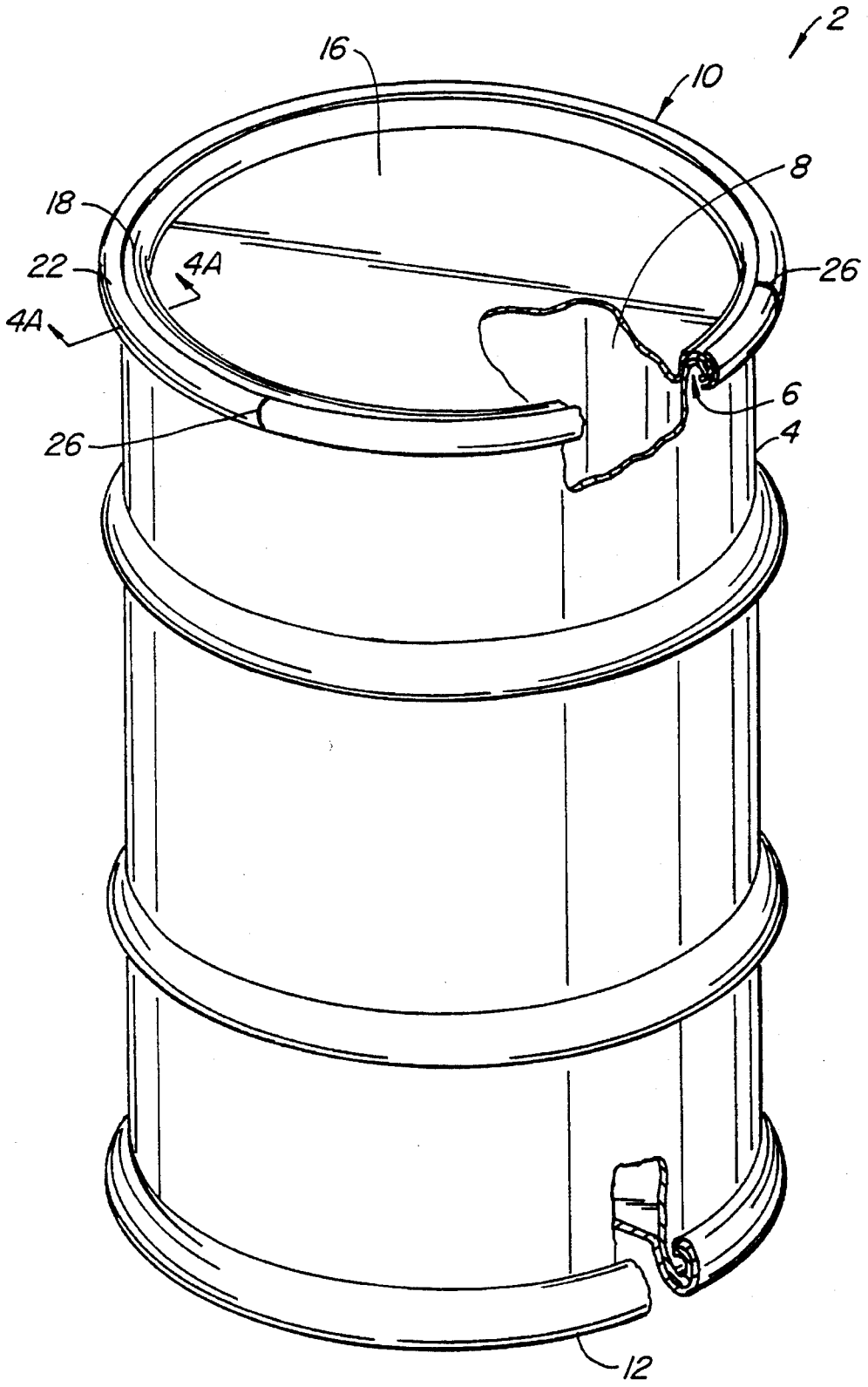
FIG. 1 is a perspective view of an open head drum having a removable lid fastened to a drum seat.

Referring to open head drum 2 for storing and transporting perishable food products, such as diced tomatoes, is illustrated. As shown in FIG. 1, drum 2 is a conventional 55 gallon drum generally comprising a hollow tubular drum body 4 having an integrally attached circular end wall 12 closing one end of drum body 4 and a lid seat 6 circumscribing an open end 8 of drum body 4. Drum 2 further includes a removable drum lid 10 for co-acting with lid seat 6 to close open end 8 of drum 2, as is conventional in the art.

Figure 4A:
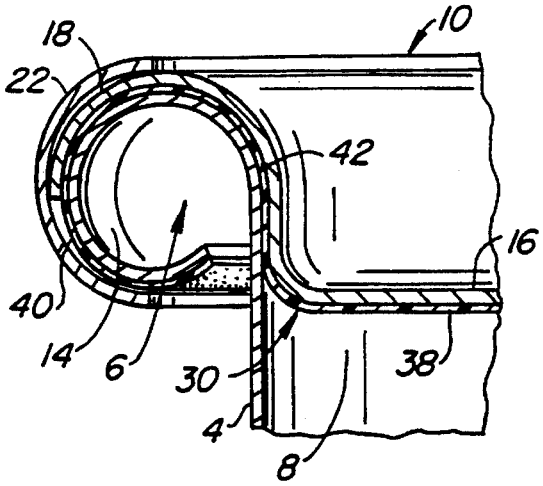
FIG. 4A is a side elevation section of the open head drum taken at lines 4—4 of FIG. 1.
Figure 4B:
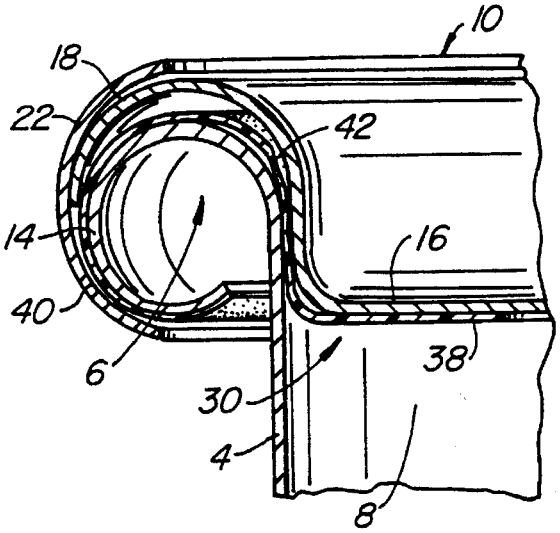
FIG. 4B is a side elevation section of the open head drum taken at lines 4—4 of FIG. 1 illustrating the relative movement occurring at the removable lid and drum seat during dynamic jarring movement and illustrating the function of the improved seal of this invention to prevent the ingress of air to the contents interior of the drum.

As shown in FIGS. 4A and 4B, lid seat 6 extends radially outward from open end 8 of drum body 4 and has a partial spiral cross-section in the illustrated section, comprising an arcuate outer wall 14 that circumscribes open end 8.

Removable drum lid 10 is a conventional open head lid having an inner circular wall 16 for closing open end 8 of drum body 4 and a rounded outer wall 18 surrounding inner wall 16. Outer wall 18 of lid 10 generally conforms to a portion of outer wall 14 of drum body 4 for cooperating with lid seat 6 to secure lid 10 to the lid seat, thereby closing open end 8 of hollow tubular drum body 4.

It should be understood the improved seal of the present invention will be shown and described in, conjunction with a conventional 55 gallon open head drum, it is not intended to be limited in that manner. That is, the improved seal can be used with other types of drums and other types of containers that can be re-used, such as tomato paste cans or a variety of other conventional containers.

A bump ring 22, preferably constructed of metal, is wrapped around outer wall 18 of drum lid 10 to secure drum lid 10 to lid seat 6. Bump ring 22 preferably has two holes (not shown) near the ends for receiving ties 26 to secure bump ring 22 to outer wall 18 of lid 10. Ties 26 secure bump ring 22 to lid 10 and can be easily removed by loosening the ties or cutting them. To this end, ties 26 are preferably made of a resilient material having good tensile strength, such as nylon cable. Suitable ties can be obtained from Panduit Electric of Tinley Park, Ill. (Model #PLT5H). Of course, it will be readily recognized that other fasteners may be used to secure bump ring 22 to lid 10, such as a conventional bolt.

Figure 2A:
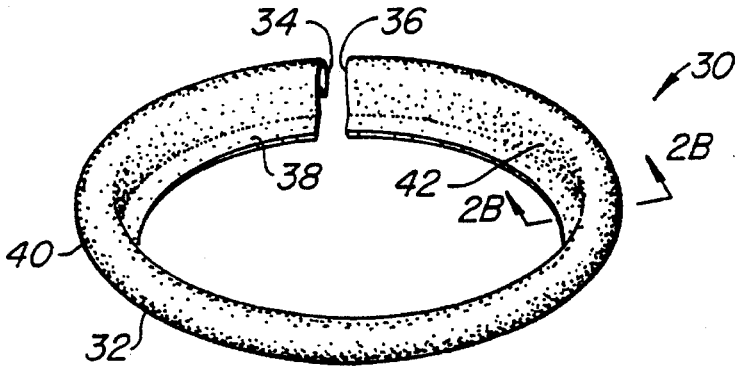
FIG. 2A is a perspective view of a sealing membrane for the drum of FIG. 1.

FIG. 2A illustrates a sealing membrane 30 for sealing the interior of open head drum 2. Sealing membrane 30 comprises an elongate body 32 having first and second ends 34, 36 and a length therebetween slightly greater than the circumference of lid seat 6. This length enables membrane 30 to be wrapped around lid seat 6 and fused at its distal ends, forming an endless, annular seal between lid seat 6 and lid 10, as discussed in greater detail below. Elongate body 32 will also have a sufficient width to extend from the outer portion of lid seat 6 to inner surface of removable drum lid 10 interior of drum body 4. Most importantly, this width is sufficient to define the flexible portion 42 of the membrane between the fastening points to the lid and drum rim.

Sealing membrane 30 preferably comprises a plastic material that is substantially impermeable to oxygen to prevent spoilage of food products in the interior of drum 2. In the preferred embodiment, membrane 30 comprises a low density, linear polymer, such as polyethylene. Of course, other sealing materials or a combination of materials may be used so long as the materials are substantially impermeable to oxygen.

Figure 2B:
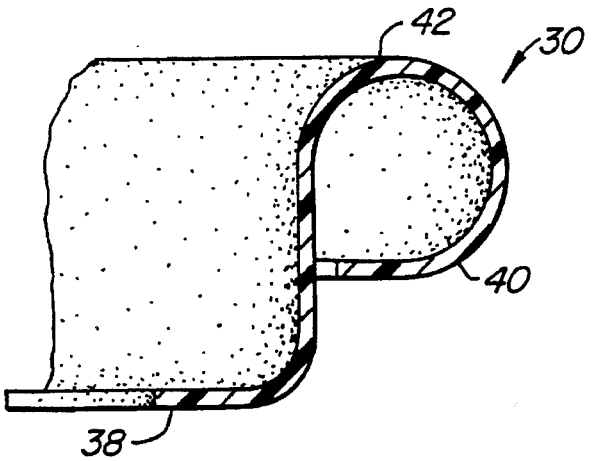
FIG. 2B is an enlarged side cross-sectional view of a portion of the sealing membrane of FIG. 2A taken at lines 2—2 of FIG. 2A.

As shown in FIG. 2B, sealing membrane 30 is formed into a shape having a cross-section generally conforming to lid seat 6 and outer wall 18 of removable lid 10. Specifically, membrane 30 includes an inner, annular portion 38, an outer annular portion 40 and a middle, flexible portion 42 between the inner and outer portions 38, 40. As shown in FIG. 4B, inner portion 38 is substantially planar so that it will conform to inner wall 16 of lid 10. Outer and middle portions 40, 42 generally correspond to the outer surface of lid seat 6 and arcuate outer wall 18 of lid 10.

Figure 3:
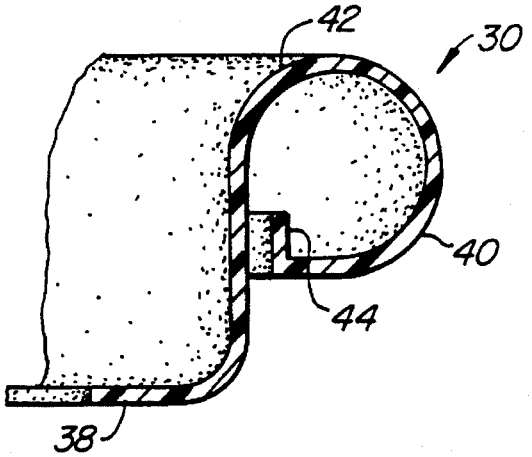
FIG. 3 is an enlarged side cross-sectional view of a portion of another sealing membrane similar to FIG. 2B.

It should be noted that sealing membrane 30 may have configurations other than that discussed above and shown in FIG. 2B. For example, inner portion 38 of membrane 30 may include a lip 44 (see FIG. 3) that extends transversely to portion 38. Lip 44 can be wrapped around the end of lid seat 6 to enhance the bond between inner portion 38 and lid seat 6. Alternatively, sealing membrane 30 may comprise a simple, flexible strip of plastic that is manually deformed by the handler to conform to lid seat 6 and lid 10 of drum 2.

In a specific configuration, inner portion 38 of sealing membrane 30 is preferably bonded to inner wall 16 of lid 10 and outer portion 40 is bonded to the outer surface of lid seat 6 to effect a secondary seal for drum 2, as shown in FIG. 4B. Preferably, a suitable bonding agent, such as IP3138 Lacquer from Courtaulds Coatings, Inc. of Louisville, Ky., is used to attach inner and outer portions 38, 40 to lid seat 6 and lid 10, respectively. As illustrated by FIGS. 4A and 4B, middle portion 42 of sealing membrane 30 is not attached to either lid 10 or lid seat 6. Thus, when drum 2 is jarred during transport and lid 10 momentarily separates from lid seat 6, middle portion 42 will give way or move with lid 10, thereby providing flexibility to sealing membrane 30 so that sealing membrane 30 will not tear or rip.

Figure 5A:
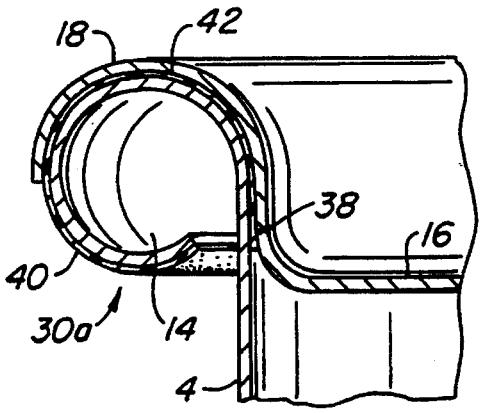
FIG. 5A is a side elevation section of an open head drum illustrating an alternative method of bonding a sealing membrane to the removable lid and drum seat of FIG. 1.
Figure 5B:
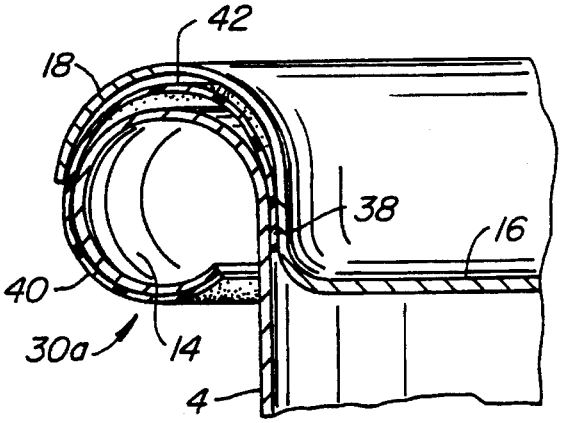
FIG. 5B is a side elevation section illustrating the relative movement occurring at the lid and drum seat during dynamic jarring movement with the sealing membrane of FIG. 5A.

It should be understood that sealing membrane 30 may be attached to lid seat 6 and removable lid 10 in manners other than that described above. In another embodiment, inner portion 38 of sealing membrane 30 is bonded to the inner surface of outer wall 18 of lid 10, rather than inner wall 16, as shown in FIGS. 5A and 5B. In this embodiment, sealing membrane 30*a* is more narrow than the sealing membrane 30 described above and, therefore, may be less expensive to manufacture.

Alternatively, inner portion 38 of sealing membrane 30 may be attached to the inner surface of drum body 4 and outer portion 40 bonded to lid 10 (i.e., the reverse of the above embodiments). For example, in the embodiment shown in FIG. 5B, inner portion could be attached to the inner surface of drum body 4 and outer portion attached to the inner surface of outer wall 18.

There are a variety of other ways the membrane ring may be configured and attached to the drum and drum head. There could be an accordion shaped ring bonded to the lid seat (6) and the lid outer wall (18). The membrane could also attach to outer portion of the lid seat (6) and to the exterior of the lid at (18). All there should effect the desired end of having a bond to the body and a bond to the head with a flexible membrane between the two bonds.

Sealing membrane 30 is preferably extrusion formed into an elongate, generally linear, strip having the cross-sectional shape shown in FIG. 2B and a length slightly longer than the circumference of lid seat 6. The extruded plastic has rigidity which facilitates the bonding of sealing membrane 30 with drum 2. In a specific configuration, solid plastic in granulated or powered form is fed into a heat chamber, such as an oven, and then extruded through a die having the desired shape. The hot plastic is then cooled by contact with air or water to set the shaped formed by the die. Of course, membrane 30 may be formed by other conventional methods, e.g., injection or rotational molding, vacuum forming, etc.

Once sealing membrane 30 has been formed, a suitable bonding agent is applied to opposite surfaces of inner and outer portions 38, 40 (i.e., the surfaces that will contact lid seat 6 and lid 10). Sealing membrane 30 is then dispensed around lid seat 6 so that outer portion 38 conforms to lid seat 6 and ends 34, 36 of body 32 overlap each other. Ends 34, 36 are fused together and outer portion 38 is attached to lid seat 6. Removable lid 10 is then positioned over open end 8 of drum body 4 and pressed downward so that inner portion 40 of membrane 30 bonds to inner wall 16 of lid 10 and outer wall 18 of lid 10 co-acts with lid seat 6 to close lid 10 onto drum body 4. The assembled drum is then heated to a prescribed temperature and time to effect the bond.

The extruded inner portion 40 of sealing membrane 30 will have enough rigidity to attach itself to the inner surface of lid 10, rather than deflecting downward when lid 10 is pressed onto membrane 30.

Once lid 10 has been attached to lid seat 6, bump ring 22 is wrapped around outer wall 18 of lid 10 and secured with ties 26. Drum 2 is now ready for shipment. If it is desired to access the contents of drum 2, lid 10 can be readily removed by untying or cutting ties 26 and prying lid 10 off lid seat 6 with a suitable tool, such as a screwdriver or chisel.

As an option, to close lid 10 back onto drum body 4, the bonding agent may be re-applied to inner and outer portions 38, 40 of sealing membrane 30 or a new sealing membrane 30 may be used to re-establish the flexible secondary seal between lid seat 6 and lid 10. The reader will understand that this is not required.

Other modifications and variations can be made to disclose embodiments without departing from the subject invention as defined in the following claims. For example, sealing membrane 30 may be constructed as a circular disk, rather than an endless, annular strip. In this case, the outer portion of the sealing disk would be wrapped around lid seat 6 and the inner portion would be bonded to removable lid 10. The middle portion between the inner and outer portion would be free to provide the required flexibility to the circular sealing membrane.

What is claimed is:

1. An open head drum with improved seal comprising:

a hollow tubular drum body;

an integrally attached circular end wall closing one end of the hollow tubular drum body;

the hollow tubular drum body defining an open end;

a lid seat defined in the hollow tubular drum body adjacent the open end for receiving a removable drum lid;

a removable drum lid having a first portion for closing the open end of the hollow tubular drum body and a second portion for co-acting with the lid seat in sealed relationship for closing the hollow tubular drum body; and an endless sealing membrane continuously around the lid seat and the removable drum lid, the endless sealing membrane having a first annular portion attached to the lid seat, a second portion attached to the removable drum lid at a distance removed from the drum seat so as to define a planar spatial annulus between the drum seat along an annulus on the removable drum lid, and a flexible annular portion between the first and second portions, said flexible annular portion disposed immediately adjacent and over the planar spatial annulus between the drum seat and the removable drum lid whereby when separation of the removable lid from the seat occurs the endless sealing membrane at the flexible annular portion is substantially linearly disposed to prevent ingress of atmosphere interior of the drum.

2. An open head drum with improved seal according to claim 1 further comprising a bump ring disposed around the second portion of the removable drum lid and the lid seat for protecting the seal therebetween.

3. An open head drum with improved seal according to claim 1 wherein the first annular portion is on the inside of the endless sealing membrane and the second annular portion is on the outside of the endless sealing membrane.

4. An open head drum with improved seal according to claim 1 wherein the second portion of the sealing membrane is annular.

5. An open head drum with improved seal according to claim 1 wherein the second portion of the sealing membrane is bonded to the first portion of the removable lid.

6. An open head drum with improved seal according to claim 1 wherein the second portion of the sealing membrane is bonded to the second portion of the removable lid.

7. An open head drum with improved seal according to claim 1 wherein said sealing member is an elongate strip that has been extrusion formed from a plastic material.

8. An open head drum with improved seal according to claim 1 said sealing membrane comprises a material substantially impermeable to oxygen.

9. An improved seal for an open head drum of the type including;

a hollow tubular drum body defining an open end and a closed end;

a lid seat defined in the hollow tubular drum body adjacent the open end for receiving a removable drum lid;

a removable drum lid having a first portion for closing the open end of the hollow tubular drum body and a second portion for co-acting with the lid seat in sealed relationship for closing the hollow tubular drum body; the improved seal comprising:

an endless sealing membrane continuously around the lid seat and the removable drum lid, the endless sealing membrane having a first annular portion attached to the lid seat, a second annular portion attached to the removable drum lid at a distance removed from the drum seat so as to define a planar spatial annulus between the drum seat along an annulus on the removable drum lid, and a flexible annular portion between the first and second annular portions, said flexible annular portion disposed immediately adjacent and over the planar spatial annulus between the drum seat and the removable drum lid whereby when separation of the removable lid from the seat occurs the endless sealing membrane at the flexible annular portion is substantially linearly disposed to prevent ingress of atmosphere interior of the drum.

10. A process for providing an open head drum with an improved seal according to claim 9 and wherein the step of providing an endless sealing membrane continuously around the lid seat and the removable drum lid includes:

providing a strip having a sufficient width to define the first annular portion attached to the lid seat, the second portion attached to the removable drum lid, and the flexible portion therebetween; and dispensing the strip to form an endless sealing membrane around the lid seat and removable lid.

11. A process for providing an open head drum with an improved seal, wherein the open head drum includes;

a hollow tubular drum body defining an open end and a closed end;

a lid seat defined in the hollow tubular drum body adjacent the open end for receiving a removable drum lid;

a removable drum lid having a first portion for closing the open end of the hollow tubular drum body and a second portion for co-acting with the lid seat in sealed relationship for closing the hollow tubular drum body;

the process including the steps of:

providing an endless sealing membrane continuously around the lid seat and the removable drum lid;

attaching the endless sealing membrane at a first annular portion to the lid seat;

attaching the endless sealing membrane at a second portion to the removable drum lid at a distance removed from the drum seat so as to define a planar spatial annulus between the drum seat along an annulus on the removable drum lid; and, spacing the first annular portion and the second annular portion apart one from the other to provide a flexible annular portion disposed immediately adjacent and over the planar spatial annulus between the drum seat and the removable drum lid between the first and second annular portions whereby, when separation of the removable lid from the seat occurs, the endless sealing membrane at the flexible annular portion is substantially linearly disposed to prevent ingress of atmosphere interior of the drum.

12. A process for providing an open head drum with an improved seal according to claim 11 and wherein the step of dispensing the strip to form an endless sealing membrane around the lid seat and removable lid includes;

overlapping first and second end portions of the strip as the strip circumscribes the lid seat; and, fusing the end portions of the strip together to form the endless sealing membrane.

13. A process for providing an open head drum with an improved seal according to claim 11 further including the step of extrusion forming an elongate plastic strip defining the first portion conforming to the lid seat, the second portion conforming to the removable drum lid and the flexible portion therebetween.

* * * * *